United States Patent [19]

Okada

[11] Patent Number: 4,646,543

[45] Date of Patent: Mar. 3, 1987

[54] KNITTING NEEDLE WITH A FLEXIBLE CORD

[75] Inventor: Hidekazu Okada, Ashiya, Japan

[73] Assignee: Clover Mgf. Co., Ltd., Osaka, Japan

[21] Appl. No.: 857,476

[22] Filed: Apr. 30, 1986

[30] Foreign Application Priority Data

Apr. 30, 1985 [JP] Japan ..... 60-65561[U]

[51] Int. Cl.[4] ..... D04B 35/02

[52] U.S. Cl. ..... 66/117

[58] Field of Search ..... 66/116, 117, 118

[56] References Cited

U.S. PATENT DOCUMENTS

| | | | |
|---|---|---|---|
| 1,999,691 | 4/1935 | Graham | 66/117 |
| 2,102,600 | 12/1937 | Miller | 66/117 |
| 2,208,124 | 7/1940 | Donn | 66/117 |
| 2,695,506 | 11/1954 | Kohlmann | 66/117 |
| 4,341,094 | 7/1982 | Heide | 66/117 |
| 4,553,410 | 11/1985 | Hidekazu | 66/117 |

*Primary Examiner*—Ronald Feldbaum

*Attorney, Agent, or Firm*—Birch, Stewart, Kolasch & Birch

[57] ABSTRACT

A knitting needle with a flexible cord, comprising: a bamboo or wood needle body having a tapered rear end section which includes a joint face and a conical peripheral surface and has an axial bore formed therein; a headed reinforcing member having an enlarged head formed at a rear end of a shank which is fastened to the bore of the rear end section and has an axial mounting bore extending thereinto through the head which includes a conical peripheral surface, a forward joint face and a rearward joint face; and a flexible cord having an enlargement which includes a forward joint face, a conical peripheral surface and an axial extension extending forwardly from the enlargement into the bore of the reinforcing member, wherein the peripheral surface of the reinforcing member is interposed between and flush with the peripheral surface of the rear end section and the peripheral surface of the enlargement, with the rearward joint face of the rear end section bonded to the forward joint face of the reinforcing member and with the forward joint face of the enlargement bonded to the rearward joint face of the reinforcing member.

7 Claims, 11 Drawing Figures

KNITTING NEEDLE WITH A FLEXIBLE CORD

BACKGROUND AND SUMMARY OF THE INVENTION

This invention relates to a knitting needle with a flexible cord, and more particularly to improvements in the knitting needle of such a particular type that has the flexible cord formed of synthetic resin and connected with one or two rigid needle shanks made of bamboo or wood.

More specifically, the invention relates to reinforcement at a junction between the flexible cord and the rigid needle body.

The knitting needles with a flexible cord are classified into two types, one being a circular type that has a pair of rigid needle bodies joined by an intermediate flexible cord as illustrated in FIG. 1 of the accompanying drawings, and another being a non-circular type that has a single rigid needle body connected to a flexible cord on which a stitch stop is mounted as illustrated in FIG. 2.

Conventionally, the needle bodies for the above two types have been made of metal or rigid synthetic resin. Recently, however, bamboo is actually utilized for manufacture of needle bodies for the above two type needles, and demand therefor increases year by year because of their good natural properties such as a proper weight, a good feeling in touch and an easiness to provide a slippery and lustrous surface.

As is well known, however, bamboo is not so tough and strong in nature as metal and rigid synthetic resin. Naturally, a bamboo needle body is easily damageable or broken especially at its thin-walled rear terminal end to which a flexible cord is connected.

Therefore, several attempts have been made to provide reinforcement at a junction between the flexible cord and the bamboo needle body, as disclosed for example in the Applicant's Japanese Utility Model Application Laid-open Nos. 59-37384 (laid-open Mar. 9, 1984, Application No. 57-131060, filed Aug. 30, 1982) and 59-109791 (laid-open July 24, 1984, Application No. 58-2534, filed Jan. 11, 1983), in which a rigid, tubular reinforcing member having no enlarged head is fully inserted into and fastened to an axial bore formed in a thin-walled rear end section of a bamboo needle body, and a connecting end section of a flexible cord is inserted into and fastened to the tubular reinforcing member.

However, the reinforcing structure proposed in the above two prior arts have proved insufficient because a thin-walled rear terminal end of the bamboo needle body is too weak and fragile.

It is, therefore, an object of the invention to provide an improved joint structure for connecting a flexible cord to a rear end section of a bamboo needle body, which permits a sufficient reinforcement at a junction between the needle body and the flexible cord.

Another object of the invention is to provide an improved joint structure for connecting a flexible cord to a rear end section of a bamboo needle body, which permits a smooth surface continuity at a junction between the needle body and the flexible cord.

The joint structure according to the invention is readily applicable to the connection of a flexible cord with a wood needle body which may be substituted for a bamboo needle body.

It is, therefore, a further object of the invention to provide a reinforced joint structure for connecting the flexible cord to a rear end section of the wood needle body.

Other objects, features and advantages of the invention will become apparent from the detailed description given hereinafter.

According to the present invention, there is provided a knitting needle with a flexible cord, comprising: at least one rigid needle body made of bamboo or wood and having a tapered rear end section which includes a rearward joint face and a substantially conical peripheral surface and has an axial bore formed therein; a reinforcing member which is inserted into and fastened to the axial bore of the rear end section and has an axial mounting bore formed therein; and a flexible cord formed of a synthetic resin and having an enlargement which includes a forward joint face, a substantially conical peripheral surface and an axial extension extending forwardly from the enlargement into the axial mounting bore of the reinforcing member and fastened thereto, characterized in that the reinforcing member is a headed reinforcing member which includes a cylindrical shank and an enlarged head formed at a rear end of the shank and has an axial mounting bore extending through the enlarged head into the shank, the enlarged head including a substantially conical peripheral surface, a forward joint face and a rearward joint face, wherein the peripheral surface of the enlarged head of the reinforcing member is interposed between and substantially flush with the peripheral surfaces of the rear end section and the enlargement, and the rearward joint face of the rear end section is bonded to the forward joint face of the enlarged head while the forward joint face of the enlargement is bonded to the rearward joint face of the enlarged head.

DESCRIPTION OF THE PREFERRED EMBODIMENTS

Figure 1:
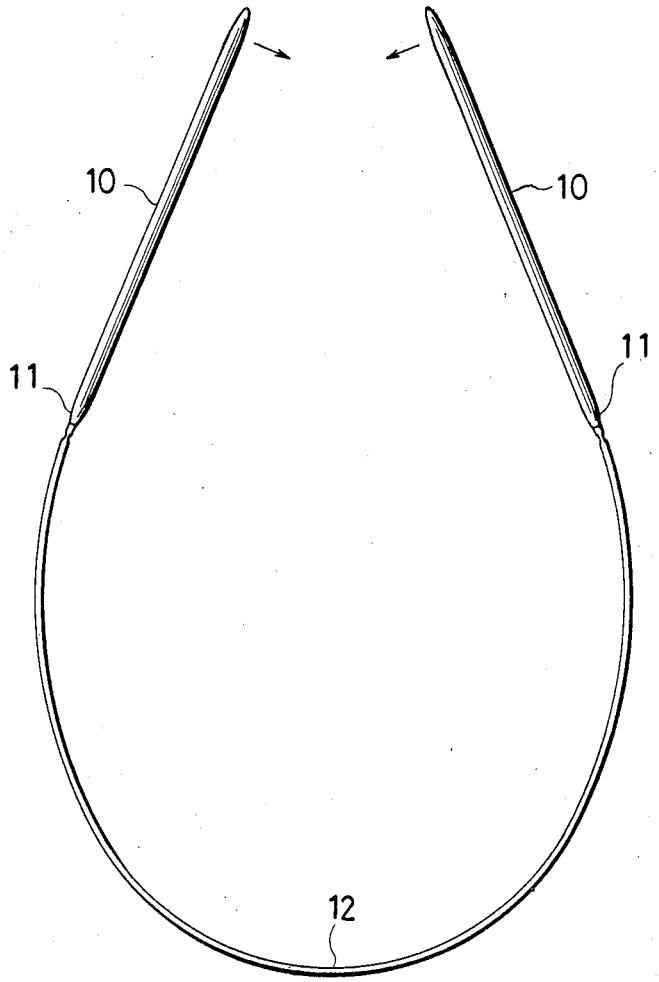
FIG. 1 is a perspective view showing a circular knitting needle with a flexible cord, to which the present invention can be applied.
Figure 2:
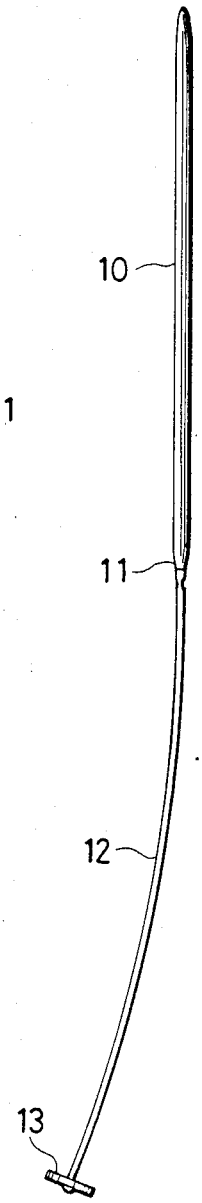
FIG. 2 is a perspective view showing a non-circular type knitting needle with a flexible cord, to which the invention can be applied.

Referring now to the drawings, in which identical reference numerals are used throughout various views to designate not only identical but also substantially like or corresponding parts or elements, FIG. 1 illustrates a circular knitting needle having a pair of rigid needle bodies 10 joined at their rear ends 11 by a middle flexible cord 12, while FIG. 2 illustrates a non-circular knitting needle which includes a single rigid needle body 10, a flexible cord 12 connected to the rear end 11 of the needle body 10, and a known stitch stop 13 slidably or fixedly mounted on the flexible cord 12, conventionally. The present invention is applicable to any of these two types of knitting needles with a flexible cord.

According to the present invention, each rigid needle body 10 is made of bamboo or hard wood. In the illustrated embodiments of FIGS. 1 and 2, each needle body 10 has a straight bar-like configuration. It may, however, be formed at its front free end with an unillustrated hook to provide a known crochet hook.

Figure 3:
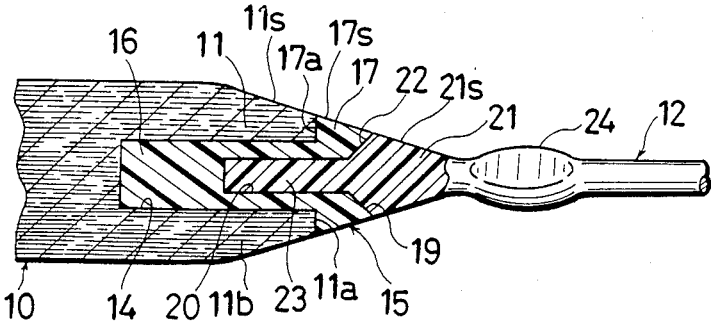
FIG. 3 is an enlarged, fragmentary longitudinal section showing a first embodiment according to the invention.

As illustrated in FIG. 3, the rear end section 11 of the needle body 10 is formed with a cylindrical axial bore 14 which is substantially coaxial with the longitudinal axis of the needle body 10 and extends from its rear end wall 11*a* into the needle body 10 within a suitable limited range, preferably beyond an axial length of the tapered rear end section 11.

The rear end section 11 is tapered or gradually reduced in diameter, so that the thickness of the cylindrical wall 11*b* surrounding the axial bore 14 is minimized at the rear terminal end 11*a* of which annular end wall serves as a rearward joint face.

A headed reinforcing member 15, formed of rigid synthetic resin such as ABS, has a cylindrical shank 16 and an enlarged conical head 17 formed at a rear end of the shank 16. The cylindrical shank 16 may preferably be formed with a plurality of narrow grooves 18 which are angularly spaced apart from each other as best shown in FIG. 4B, and extend along the length of the shank 16 for the purpose to be hereinafter described.

The enlarged head 17 has a forward annular joint face 17*a* which is bonded to the rearward annular joint face 11*a* by adhesive. A diameter of the body 10 at its rear terminal end 11*a* is substantially equal to that of the enlarged head 17 at its forward end 17*a*, so that the conical peripheral surface 11*s* of the rear end section 11 is substantially flush with the conical peripheral surface 17*s* of the tapered head 17 to provide a smooth surface continuity therebetween.

The shank 16 is shorter in axial length than the bore 14, so that the joint faces 11*a*, 17*a* can be in tight contact with each other when the shank 16 is fully inserted into the bore 14. An external diameter of the shank 16 is slightly smaller than an internal diameter of the bore 14 so that the shank 16 can be snugly fitted into the bore 14 with a layer of adhesive coated on the cylindrical surface of the shank 16. Thus, the reinforcing member 15 is firmly bonded to the rear end section 11 of the needle body 10, by the adhesive applied on the joint faces 11*a*, 17*a* and cylindrical fitting surfaces of the shank 16 and the bore 14.

Figure 4C:
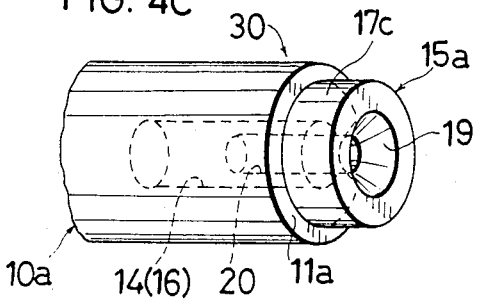
FIG. 4C is an enlarged, fragmentary perspective view showing the blanks of the headed reinforcing member and the bamboo needle body bonded together and formed with an axial mounting bore having a flared opening.
Figure 5A:
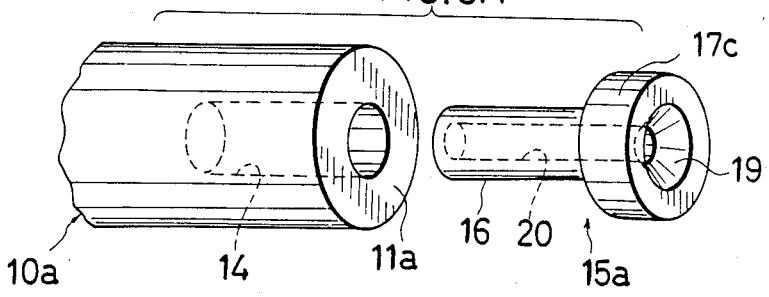
FIG. 5A is an enlarged, fragmentary perspective view showing a second embodiment according to the invention, in which a blank of the reinforcing member is pre-bored.
Figure 5B:
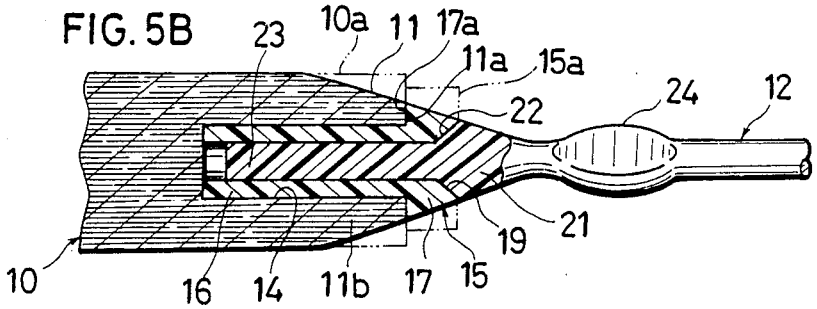
FIG. 5B is an enlarged, fragmentary longitudinal section showing a manner of shaping the bonded blanks of FIG. 5A and the resulted joint structure.

The conical head 17 is formed with a flared opening defined by a conical wall 19 serving as a rearward joint face to be hereinafter described. The opening 19 communicates with a cylindrical axial mounting bore 20 which extends inwardly from the opening 19 into the shank body 16 as illustrated in FIGS. 3 and 4C. The bore 20 is substantially coaxial with a longitudinal axis of the shank 16. The bore 20 may be in either form of a blind hole as shown in FIG. 3 or a through hole as illustrated in FIGS. 5A, 5B.

The flexible cord 12, round in cross section, may preferably be formed of thermoplastic synthetic resin of flexible nature such as nylon.

Each connecting end of the cord 12, at which it is fastened to the headed reinforcing member 15, is formed with an enlargement 21 which has a forward conical joint face 22 bonded by adhesive to the rearward conical joint face 19 of the enlarged head 17. The enlargement 21 has a conical peripheral surface 21*s* which is shaped so as to be flush with the described conical peripheral surfaces 11*s*, 17*s*, so that stitches of yarn (not shown) can pass freely over the joints between the needle body 10 and the reinforcing member 15, and between the member 15 and the flexible cord 12.

The connecting end of the cord 12 is formed with a predetermined length of axial extension 23 which extends forwardly from the enlargement 21 into the mounting bore 20. The extension 23 is cylindrical in shape, slightly less in axial length than the mounting bore 20, and corresponding in diameter to the bore 20.

The flexible cord 12 may preferably be partially deformed for example into a substantially flat shape at a position near the rear of the enlargement 21 to provide a relatively easily bendable portion 24. Thus, bending strains imparted to the cord itself or the joints between the cord and the needle body 10 can be sometimes advantageously dispersed or absorbed at the portion 24. Provision of such easily bendable portion 24 per se is known and does not feature the present invention.

The joint structure of the first embodiment as shown in FIG. 3 can be realized as follows.

Figure 4A:
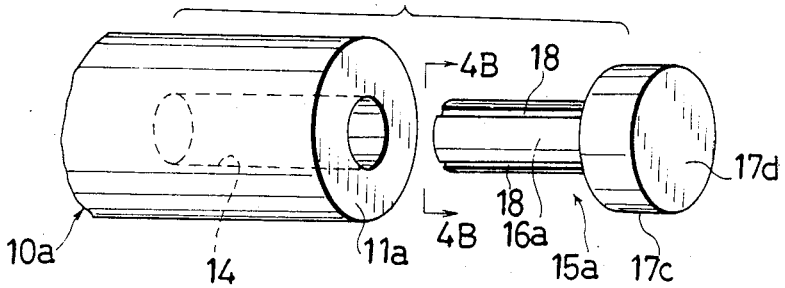
FIG. 4A is an enlarged, fragmentary perspective view showing blanks of a bamboo needle body and a headed reinforcing member.
Figure 4B:
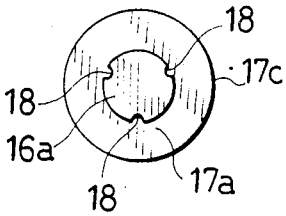
FIG. 4B is an end view taken along lines 4B—4B in FIG. 4A.

As illustrated in FIG. 4A, a blank 15*a* of the reinforcing member is prepared which has a solid shank 16*a* and a solid enlarged head 17*c*. The blank shank 16*a* may preferably be formed with a plurality of narrow axial grooves 18 as described. A blank rear end section 10*a* of the needle body 10 is formed with the described axial bore 14.

After application of a known suitable adhesive on the surfaces of the blank shank 16*a* and the forward annular joint face 17*a* of the head 17*c*, the shank 16*a* is fully inserted into the bore 14 until the forward joint face 17*a* is pressed against the rearward joint face 11*a* of the blank 10*a*. As a result, the blank reinforcing member 15*a* is firmly bonded to the blank rear end section 10*a* of the needle body.

When the blank shank 16*a* is inserted into the axial bore 14, the air confined in the bore 20 is likely to hinder an easy insertion of the shank 16*a* into the bore 20. This problem can be solved by provision of the described grooves 18 which serve as air-outlet passages. For this purpose, provision of only one passage may be sufficient. However, provision of two or more passages 18 is preferable because one or some of the passages may be choked up with the adhesive applied on the shank surface which may be unexpectedly extended to intrude into the passages.

Then, by axially applying a known tool such as a drill at the center of an outer end face 17*d* of the blank enlarged head 17*c*, the blank member 15*a* is formed with the axial bore 20 which extends from the outer face 17*d* into the shank 16*a*. Then, the opening mouth of the bore 20 at the face 17*d* is flared out by means of a suitable tool to provide the described conical joint face 19 as illustrated.

Figure 4D:
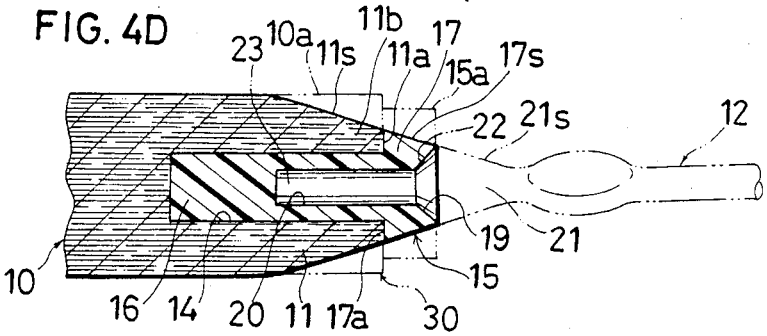
FIG. 4D is an enlarged, fragmentary longitudinal section showing a manner of shaping the bonded blanks of FIG. 4C.

After the blank member 15*a* has been firmly bonded to the blank rear end section 10*a* and then bored as illustrated in FIG. 4C, the resulted bonded unit 30 is shaped by grinding or cutting off the phantom lined portions of the unit 30 to provide the described conical peripheral surfaces 11*s* and 17*s* which are flush with each other, as shown in FIG. 4D.

Finally, the flexible cord 12 is connected to the bonded unit 30 by applying adhesive on the external surfaces of the extension 23 as well as the forward conical joint face 22 and then inserting the extension 23 into the mounting bore 20 until the forward conical joint face 22 is pressed against the rearward conical joint face 19 of the bonded unit 30, as illustrated in FIG. 4D. Thus, the reinforced joint structure as illustrated in FIG. 3 is realized.

FIGS. 5A and 5B illustrate the second embodiment of the invention, wherein a blank 15*a* for the reinforcing member 15 is formed with the mounting bore 20 and the flared opening 19 prior to bonding the blank 15*a* to the blank needle end section 10*a*. In this embodiment, the axial bore 20 is open at its opposite ends. Therefore, the bore 20 in this case serves as air-outlet passage when the shank 16 is inserted into the axial bore 14 of the blank 10*a*. The consequent steps for realizing the joint structure as illustrated in solid lines in FIG. 5B are substantially the same as described in the foregoing with respect to the first embodiment of the invention.

Figure 6A:
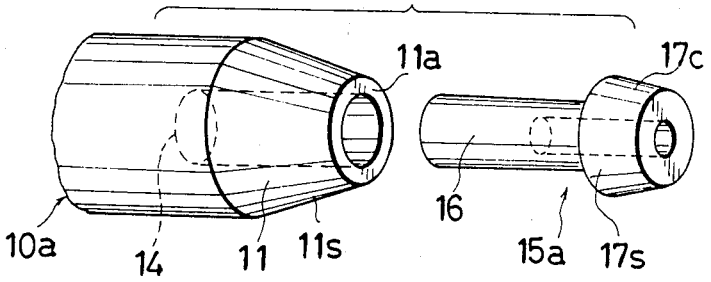
FIG. 6A is a similar view to FIG. 5A, but showing a third embodiment of the invention.
Figure 6B:
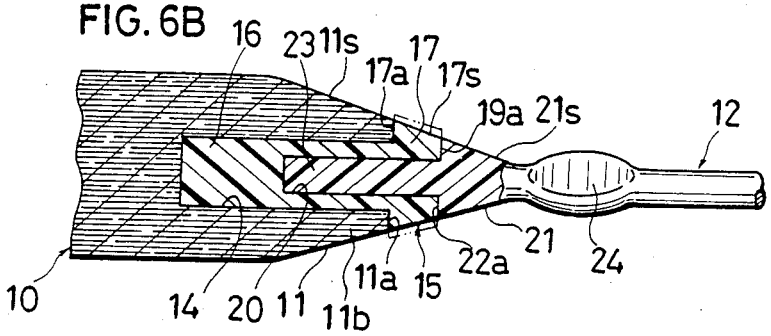
FIG. 6B is a similar view to FIG. 5B but showing a manner of flushing conical peripheries and the resulted joint structure in the third embodiment of FIG. 6A.

FIGS. 6A and 6B illustrate the third embodiment of the invention, wherein the rear end section 11 of the needle body 10 is pre-tapered while the reinforcing member 15 is pre-bored and its enlarged head 17*c* is also pre-tapered, as illustrated in FIG. 6A. Further, a forward joint face 22*a* of the flexible cord 12 and a rearward joint face 19*a* of the section 11 are not conical but annular as illustrated.

If any diametrical difference appears between the conical peripheral surfaces 11*s* and 17*s* when the needle body 10 and the reinforcing member 15 are bonded together as illustrated in FIG. 6B, such diametrical difference should be eliminated by grinding off the phantom lined portions in FIG. 6B to provide a smooth continuity between the surfaces 11*s*, 17*s*. The the flexible cord 12 is bonded to the needle body 10 by applying adhesive to the external surfaces of the extension 23 as well as the forward annular joint face 22*a* and then inserting the extension 23 into the mounting bore 20 until the forward annular joint face 22*a* is pressed against the rearward annular joint face 19*a*, whereby the reinforced joint structure as illustrated in solid lines in FIG. 6B is realized.

As described in the foregoing, the headed reinforcing member 15 is incorporated in the joint structure according to the invention, which easily permits provision of an increased wall thickness 11*b* and hence less fragility at the terminal end 11*a* of the tapered rear end section 11 of the needle body 10 which is made of bamboo or hard wood that is relatively weak and easily damageable in nature when compared with known metal or synthetic resin made needle bodies. An axial length as well as diameter of the enlarged head 17 can be varied easily to provide a desired wall thickness 11*b* at the terminal end 11*a* even when an inclination angle of the conical peripheral surface 11*s* is constant, which is very advantageous in manufacture.

A rigid and stable adherence can be maintained between the annular joint faces 11*a* and 17*a* because both the needle body 10 and the headed reinforcing member 15 are rigid and not easily deformable. Further, adherence at the joint faces 19, 22 and 19*a*, 22*a* can be tough and stable because both of them are formed of synthetic resins, which easily permits a wide selection of effective adhesives for plastic-to-plastic bonding as well as known effective surface pre-treatments on such joint faces for enhancing the bonding effect. Thus, the flexible cord 12 can be firmly fastened to the rear end section 11 of the bamboo or wood needle body 10 via the synthetic resin made, headed reinforcing member 15, with the result that the section 11 is prevented from being damaged or broken at its thin-walled, weakest terminal end when bending strains are repeatedly imparted or concentrated thereto during knitting operation.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A knitting needle with a flexible cord, comprising at least one rigid needle body made of bamboo and having a tapered rear end section which includes a rearward joint face and a substantially conical peripheral surface and has an axial bore formed therein, a headed reinforcing member having a cylindrical shank inserted into and fastened to said axial bore of said rear end section, said headed reinforcing member further having an enlarged head formed at a rear end of said shank and an axial mounting bore extending through said enlarged head into said shank, a flexible cord formed of a synthetic resin and having an enlargement which includes a forward joint face, a substantially conical peripheral surface, and an axial extension extending forwardly from said enlargement into said axial mounting bore of said reinforcing member, said enlarged head including a substantially conical peripheral surface, a forward joint face and a rearward joint face, said conical peripheral surface of said enlarged head being interposed between and substantially flush with said conical peripheral surface of said rear end section and said conical peripheral surface of said enlargement, said rearward joint face of said rear end section being bonded to said forward joint face of said enlarged head, and said forward joint face of said enlargement being bonded to said rearward joint face of said enlarged head.

2. The knitting needle as defined in claim 1, wherein said rearward joint face of said enlarged head and said forward joint face of said enlargement are substantially conical.

3. The knitting needle as defined in claim 1, wherein said rearward joint face of said enlarged head and said forward joint face of said enlargement are annular.

4. The knitting needle as defined in claim 1, wherein said headed reinforcing member is formed with an air-outlet passage means.

5. The knitting needle as defined in claim 1, wherein said headed reinforcing member and said rear end section are formed by shaping blanks thereof together to provide a flush relation between said conical peripheral surface of said rear end section and said conical peripheral surface of said enlarged head after said headed reinforcing member has been bonded to the said rear end section.

6. The knitting needle as defined in claim 1, wherein said headed reinforcing member is formed of a solid headed blank, and said axial mounting bore of said headed reinforcing member is formed by drilling in said blank after said blank has been bonded to said rear end section.

7. The knitting needle as defined in claim 1, wherein said headed reinforcing member is formed of a pre-bored blank having said axial mounting bore of said headed reinforcing member.

* * * * *